United States Patent [19]

Fuehrer

[11] Patent Number: 4,813,568

[45] Date of Patent: Mar. 21, 1989

[54] CONTAINER WITH PLASTIC EAR ASSEMBLIES AND WIRE HANDLE AND METHOD OF MAKING THE SAME

[75] Inventor: Charles Fuehrer, Scarsdale, N.Y.

[73] Assignee: Stoffel Seals Corp., Tuckahoe, N.Y.

[21] Appl. No.: 84,126

[22] Filed: Aug. 12, 1987

[51] Int. Cl.[4] ..... B65D 25/32; B65D 25/28

[52] U.S. Cl. ..... 220/92; 220/95; 220/91; 220/94 R

[58] Field of Search ..... 220/91, 92, 95, 94 R

[56] References Cited

U.S. PATENT DOCUMENTS 2,365,099 12/1944 O'Brien ..... 220/92

4,227,623 10/1980 Woinarski ..... 220/92

*Primary Examiner*—Joseph Man-Fu Moy

*Attorney, Agent, or Firm*—Antonelli, Terry & Wands

[57] ABSTRACT

A container is disclosed with a pair of plastic ear assemblies mounted in respective openings on opposite sides of the container near an upper end thereof and a wire handle attached to the container at respective opposite ends of the wire handle which are received in respective openings in a plastic ear assemblies. A method of attaching an end of a wire handle to the container comprises the steps of inserting one end of a plastic plug of the plastic ear assembly into an opening in the container, securing a plastic cap to the one end of the plug to seal the opening in the container against leakage of liquid from the container and provide an opening in the ear assembly for attaching the end of the wire handle to the container and inserting the end of the wire handle in the opening of the cap.

4 Claims, 2 Drawing Sheets

CONTAINER WITH PLASTIC EAR ASSEMBLIES AND WIRE HANDLE AND METHOD OF MAKING THE SAME

BACKGROUND AND SUMMARY OF THE INVENTION

The invention relates to a method of providing a support on a sheet material member for attaching a component to the member. More particularly, the relates to an improved container with a wire handle and a method of making the same.

The conventional method of attaching a handle to a container (e.g., a one gallon paint can) is to mechanically clinch metal ears to a flat sheet member prior to forming and soldering the side seam of a metal cylinder. After the assembly of the container is completed, a wire handle is inserted into the metal ears located on opposite sides of the container. This method can only be accomplished where the side seam of the container is joined by means of soldering since in the case of welding, for example, the ears would interfere with the welding apparatus. There is a method of applying the ears on a container subsequent to the side seam joining operation of soldering or welding wherein the ears themselves are welded on. However such welding damages the inside coating of the can which is to separate the product from the bare steel of the container. To repair such a coating requires not only that a liquid or powder coat be applied over the damaged coating but also that means be provided, such an oven or the equivalent for curing the coating. Thus, this known method is costly and seldom used.

One attempt to avoid this problem and permit the use of a welding process is proposed in U.S. Pat. No. 4,494,898 wherein the conventional metal ear is replaced by a plastic rivet. The plastic rivet is joined to the metal container by forming up a marginal region of the metal wall around the location of an opening in the container, inserting the plastic rivet in the opening and reforming the marginal region of the metal onto the plastic rivet so that it bites into and seals around the rivet. Corrugations are provided in the marginal region of the sheet metal to prevent folding or wrinkling of the metal during reforming. Two of the plastic rivets serve as pivots for the respective ends of a plastic handle for the can, the ends of the handle having apertures which are looped over the protruding plastic rivets. This known method and arrangement has not been adopted in the United States because it does not permit the use of the conventional wire handles used in the United States and because it requires replacement of the existing apparatus for forming and attaching the wire handles to the container by an apparatus of attaching a plastic handle, in addition to a machine for punching the holes and attaching the rivets. A further limitation or drawback is that the rates of production with the existing equipment to apply plastic handles to such rivets are considerably slower than the rates of production in the United States can manufacturing lines applying the wire handles to the container.

Thus, an object of the invention is to permit the use of a welded container and at the same time the use of conventional equipment for attaching a wire handle as heretofore in use for soldered containers having metal ears.

This and other objects are attained by the container and method of the present invention wherein plastic ear assemblies according to the invention are securely mounted in respective openings provided in the container toward an upper end thereof to seal the opening against leaks from the container through the opening and form ears with respective openings within which the ends of a wire handle are inserted and retained for attaching the ends of the wire handle to the container.

Each plastic ear assembly comprises a plastic plug and a plastic cap. One end of the plug is inserted into an opening in the container during the mounting step. The plug has a flange at its other end for engaging the container about the opening on a first side of the opening. The plastic cap is secured to the one end of the plug on a second side of the opening opposite the first side during the mounting step after the plug has been inserted into the opening of the container.

In the disclosed embodiment one end of the plug which is inserted into the opening in the container is formed with buttress threads thereon for cooperating with complementary threads provided on the cap for securing the cap and plug together against the sheet material of the container about the opening therein during the mounting step. The flanged end of the plug is formed with a central boss or projection and a plurality of spaced recesses arranged concentrically about the projection for cooperation with a tool during the mounting step. The cap has a centrally located hole in an end thereof for forming the opening for receiving the end of the wire handle and also for receiving a projection on a tool during the mounting step. A plurality of spaced recesses located concentrically about the hole in cap are also provided for cooperation with the tool during the mounting step. The flange on the plug is formed with a sealing ring thereon for engaging and sealing against the container about the opening therein to prevent leakage of the paint or other contents from the container. The cap of the plastic ear assembly is in the form of a hollow cylindrical body which is closed at one end except for the hole formed therein for receiving the wire handle end and the hollow cylindrical body is internally threaded for threaded engagement with complementary shaped threads provided on the one end of the plug. When the cap and the plug are threadedly attached to one another on the container during the mounting step they firmly grip the sheet metal of the container from opposing sides to form a stable support for attaching the handle to the container and to form a liquid seal by means of the sealing ring which is pressed against the sheet metal to prevent escape of the liquid such as paint in the container through the cooperating opening. An ear, defined by the protruding configuration of the cap from the container, defines a hollow space for retaining the end of the bail or handle which is inserted into the opening of the cap.

These and other objects, features and advantages of the present invention will become more apparent from the following description when taken in connection with the accompanying drawings, which show, for purposes of illustration only, one preferred embodiment in accordance with the present invention.

DETAILED DESCRIPTION OF THE DISCLOSED EMBODIMENT

Figure 1:
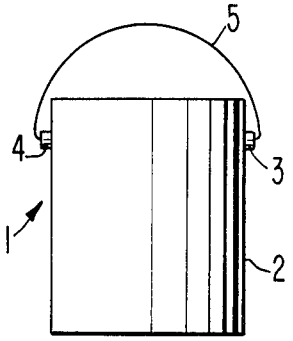
FIG. 1 is a side view of a container of the invention, particularly a paint can, having a wire handle attached to a metal container by means of a pair of plastic ear assemblies according to the method of the invention.

Referring now to the drawings, FIG. 1 illustrates a container 1 according to the present invention. The container 1 comprises a metal container wall 2, a pair of plastic ear assemblies 3 and 4 mounted on opposite sides of the container near an upper end thereof and a bail or wire handle 5 attached to the container at its ends which are received in respective openings in the plastic ear assemblies as discussed in more detail below. The container 1 is a paint can, for example.

Figure 2:
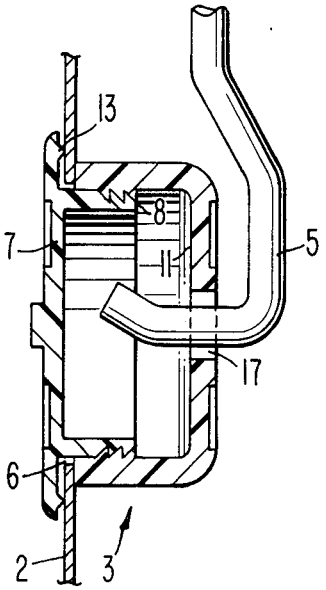
FIG. 2 is a detailed view in cross-section of one of the plastic ear assemblies attached to the sheet metal wall of the container in FIG. 1 and illustrating one end of the wire handle which has been inserted into the assembly.
Figure 3:
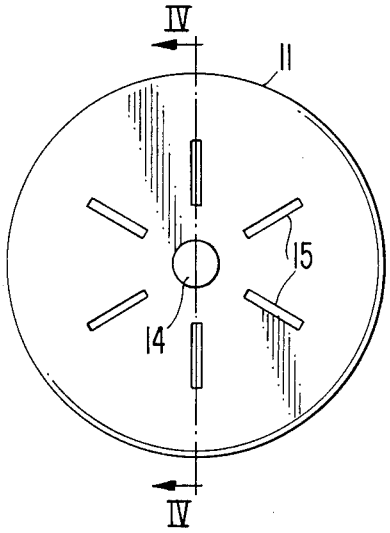
FIG. 3 is an end view of the flanged end of the plug of the plastic ear assembly shown in FIGS. 1 and 2.
Figure 4:
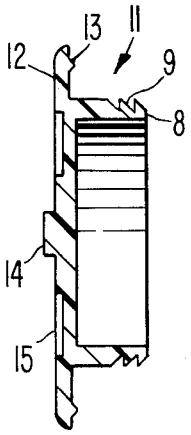
FIG. 4 is a cross-sectional view of the plug of FIG. 3 taken along the line IV—IV.

The plastic ear assemblies 3 and 4 are identical in construction. Each is mounted in an opening, see opening 6 for ear assembly 3 in FIG. 2, formed in the sheet metal of the container wall 2. The ear assembly 3 comprises a plastic plug 7 as shown in FIGS. 2–4. The plug 7 is preferably formed of a strong plastic material such as a high density polyethylene plastic having a density of 9.375 grams per cubic centimeter. Phillips Petroleum plastic type TR-880 is a commercially available plastic of this type. The plastic material has excellent solvent resistance and environmental stress crack resistance so as to resist degradation by the contents of the can, for example, paint, and the stresses thereon during lifting of the filled container with the handle 5.

Figure 5:
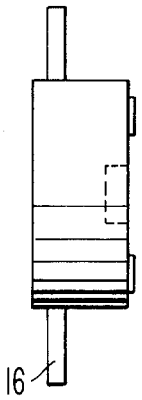
FIG. 5 is a side view of a tool which can be used to grasp the plug during mounting of the plastic ear assembly on the container.
Figure 6:
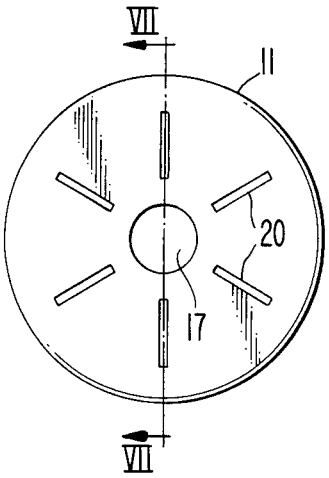
FIG. 6 is an end view of the cap of the plastic ear assembly shown in FIGS. 1 and 2.
Figure 7:
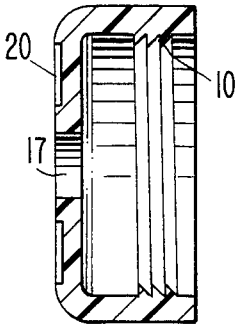
FIG. 7 is a cross-sectional view of the cap of FIG. 6 taken along the line VII—VII.

One end 8 of the plug 7 is adapted to be inserted into the opening 6 in the container 1 during mounting of the ear assembly on the container. The end 8 of the plug 7 is formed with buttress threads 9 for cooperating with complementary threads 10 formed on the interior of a plastic cap 11 of the ear assembly 3. The buttress threads 9 and 10 prevent loosening of the threaded connection between the plug and cap for maximum holding strength. Instead of or in addition to a threaded connection the plug and cap could be joined to one another by heating sealing, adhesive bonding or other joining technique. The plug 7 also includes a flange 12 at the other end thereof for engaging the container about the opening 6 on a first side thereof. The flange is formed with a seal 13 in the form of a gasketing ring for engaging in sealing relation against the container about the opening 6 to prevent liquid within the container from leaking through the opening 6. The flanged end of the plug 7 is also provided with a projection or male boss 14 and a plurality of spaced recesses 15 arranged concentrically about the projection 14 for cooperating with a corresponding recess and teeth, respectively, on a tool 16 shown in FIG. 5 during mounting of the ear assembly on the container.

Figure 8:
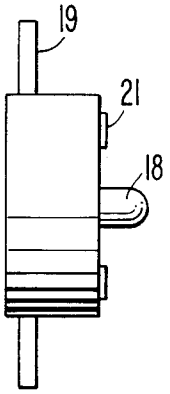
FIG. 8 is a side view of a tool for grasping and rotating the cap during mounting of the ear assembly on the container.

The plastic cap 11 is preferably formed of the same type of plastic material as the plastic plug 7. The cap is formed with a hollow cylindrical body which is provided with the buttress threads 10 about the interior of the cap for engagement with the threads on the end 8 of the plug 7. The cap is essentially closed at one end except for the presence of a centrally located opening in the form of a hole 17 for receiving the end of the wire handle 5 and retaining the same within the cap during lifting of the container with the handle. The generally hooked-shaped configuration of the end of the handle as shown in FIG. 2 prevents the end of the handle from being pulled out of the hole 17 when the handle is pulled upwardly to lift the container. The hole 17 also receives a projection 18 on a tool 19, see FIG. 8, for mounting the plastic ear assembly on the container. A plurality of spaced recesses 20 in the cap are arranged concentrically about the opening or hole 17 for cooperating with corresponding teeth 21 on the tool 19. The recesses 15 and 20 in the plug and cap, respectively, are rectangular in form in the illustrated embodiment, but could have a different configuration, but one which is compatible with a selected configuration of the corresponding teeth on the cooperating tool as will be apparent to the skilled artisan.

By way of example, the holes 6 in the sheet metal of the container 1 are preferably stamped in the sheet metal while the sheet is still flat, i.e., before the container is shaped in the form of a cylinder whose ends are then joined together as by welding, for example. However, these holes could also be formed after the container is formed and welded. The plastic ear assemblies 3 and 4 can be mounted in the holes 6 after the container side seam has been welded, so as not to interfere with the welding process, and before the container filling operation. The ends of the bail or wire handle 5 are inserted in the openings 17 in the caps 11 of the ear assemblies 3 and 4 after the ear assemblies are mounted on the container. This can be accomplished either before or after the can filling operation.

From the above, it is readily seen that the method of the invention of attaching an end of a wire handle to a container comprises the steps of mounting a plastic ear assembly in an opening provided in the container toward an upper end thereof and inserting an end of a wire handle in an opening formed in the plastic ear assembly for attaching the end of the wire handle to the container. More particularly, as illustrated in the drawings, the plastic ear assemblies 3 and 4 are mounted in respective ones of the pair of openings 6 provided in the container on opposite sides thereof. The opposite ends of the wire handle 5 are inserted in the respective openings 17 formed in the plastic ear assemblies for attaching the wire handle to the container. The plastic ear assemblies of the invention can readily be mounted in the openings of the container after the container side seam has been welded so as not to interfere with a welding operation. The assembly operation is also one which can be readily automated for production rates compatible with those on existing can manufacturing lines.

While I have shown and described only one embodiment in accordance with the present invention, it is understood that the same is not limited thereto, but is susceptible to numerous changes and modifications as known to those skilled in the art. For example, the method of the present invention is applicable to providing a support on a sheet material member for attaching a component to the member by inserting one end of the plastic plug of the plastic ear assembly of the invention into an opening provided in the sheet material member, securing a plastic cap of the ear assembly to the plug to mount the plug and the cap on the sheet material member, at least one of the plug and cap having an opening formed therein for receiving the component for attaching the component to the sheet material member. Also, the opening in the ear assembly could have a configuration other than the through hole of the disclosed embodiment. Therefore, I do not wish to be limited to the details shown and described herein, but intend to cover all such changes and modifications as are encompassed by the scope of the appended claims.

I claim:

1. A plastic ear assembly for mounting in an opening formed in a sheet material member comprising a plastic plug one end of which is adapted to be inserted into an opening formed in a sheet material member during mounting of the ear assembly, said plug having a flange at the other end thereof for engaging said sheet material member about said opening, and a plastic cap adapted to be secured to said one end of said plug after it has been inserted into said opening in said sheet material member, and wherein at least one of said plug and said cap includes an opening for receiving a portion of a member to be retained by said plastic ear assembly and said sheet material member.

2. A plastic ear assembly according to claim 1, wherein seal means are provided on at least one of said plug and said cap for sealing against said sheet material member to prevent the flow of liquid through said opening in said sheet material member after said ear assembly has been mounted therein.

3. A plastic ear assembly according to claim 1, wherein said sheet material member is a metal container and said member received in said opening of said plastic ear assembly is an end of a wire handle for said container.

4. In combination, a container, a pair of plastic ear assemblies mounted in respective openings on opposite sides of said container near an upper end thereof and a wire handle attached to said container at respective opposite ends of said wire handle which ends are received in respective holes in said plastic ear assemblies.

* * * * *